US005083135A

United States Patent [19]

Nagy et al.

[11] Patent Number: 5,083,135

[45] Date of Patent: Jan. 21, 1992

[54] TRANSPARENT FILM ANTENNA FOR A VEHICLE WINDOW

[75] Inventors: Louis L. Nagy, Warren, Mich.; Frank T. C. Shum, Minneapolis, Minn.; Jimmy L. Funke, Mt. Clemens, Mich.

[73] Assignee: General Motors Corporation, Detroit, Mich.

[21] Appl. No.: 612,295

[22] Filed: Nov. 13, 1990

[51] Int. Cl.[5] ..... H01Q 1/32

[52] U.S. Cl. ..... 343/713

[58] Field of Search ..... 343/713, 704, 711, 712

[56] References Cited

U.S. PATENT DOCUMENTS 2,944,926 7/1960 Gaiser ..... 343/704

4,757,322 7/1988 Yokogawa et al. ..... 343/713

*Primary Examiner*—Michael C. Wimer

*Assistant Examiner*—Hoanganh Le

*Attorney, Agent, or Firm*—Jimmy L. Funke

[57] ABSTRACT

A thin film antenna for a vehicle antenna is described. The principal element of the antenna is formed of a thin transparent film of conducting material having a horizontally elongate generally rectangular shape. The principal element is supported on or within the upper region of a vehicle window and is electrically fed with respect to a ground point on the vehicle body to effect coupling with the metallic structure of the vehicle and enhance antenna performance. An optional auxiliary element can be attached to the principal element to provide a means for tuning the impedance of the antenna.

2 Claims, 1 Drawing Sheet

TRANSPARENT FILM ANTENNA FOR A VEHICLE WINDOW

BACKGROUND OF THE INVENTION

This invention relates to a window glass antenna for a vehicle, and more particularly, to an antenna formed by supporting a substantially rectangular shaped transparent film of electrically conducting material on or within the upper region of a vehicle window panel.

The traditional mast or whip antenna has been used for several years to receive and transmit radio waves from a motor vehicle. Generally, these antennas have provided satisfactory performance, but they tend to distract from the aesthetic appearance of the vehicle, and several attempts have been made in the past to develop more inconspicuous type antennas that can be integrated directly into the structure of the vehicle. To this end, solid wires or opaque thick strips of conducting materials have been disposed on or within the window glass of vehicles to provide antennas for replacing conventional whip antennas. However, the antennas resulting from such efforts have unsuitably obstructed the view of the vehicle occupants, or have performed unsatisfactorily as compared to the traditional whip or mast type antenna.

More recently, attempts have been made to develop antennas formed by attaching thin transparent films of conducting materials to major central regions of vehicle windows. In general, the gain of these thin film antennas will increase as the film resistivity is decreased to reduce ohmic loss. For a given type of film, a larger conductivity (smaller resistivity) is usually achieved by increasing the thickness of the film, which in turn diminishes its transparency. Consequently, as film thickness is increased to improve antenna gain, a point will eventually be reached, where these antennas will no longer appear sufficiently transparent to vehicle occupants, and will be unacceptable because they occupy major central areas of windows. Thus, the trade off between acceptable antenna performance and suitable transparency is a factor limiting the usefulness of currently known configurations of thin film antennas for vehicle windows.

Therefore, a need exists for a thin film antenna, which does not have to occupy a major central region of a vehicle window, so that an acceptable antenna gain can be achieved by increasing the film conductivity, without making the antenna unsightly or unsuitably conspicuous to vehicle occupants.

SUMMARY OF THE INVENTION

In accord with this invention there is provided a transparent conducting film antenna for the upper portion of window glass, which is disposed within an aperture formed in the metallic structure of a vehicle. The antenna includes a principal element formed of a thin transparent film of electrically conducting material, in the general shape of a horizontally elongate rectangle, which is supported on or within the vehicle window glass. The upper and lower edges of the principal element are separated by a width W, with the upper edge spaced a distance D from the top edge of the window glass. The dimensions W and D are selected such that their sum does not exceed one-third of the distance separating the top and bottom edges of the window, thereby confining the principal element to the upper region of the window glass.

The principal element is electrically fed with respect a ground point on the vehicle to electromagnetically couple the principal element to the vehicle metallic structure. By effective utilization of this coupling, the transparent film antenna can be restricted to the upper region of the vehicle window, and still provide adequate performance. As a consequence, less transparent, but more conductive films may be used in fabricating the antenna. Thus ohmic loss can be reduced to improve antenna gain, without unsuitably obstructing the view of vehicle occupants.

Preferably, the principal element of the antenna is symmetrically positioned about the vertical center line of the window, with a feed point located at the center of its upper edge. Although other asymmetrical configurations may be used, it has been found that centering the principal element and its feed point on the window produces the best antenna performance, in most applications.

As contemplated by a further aspect of the invention, when the upper region of the vehicle window includes a tinted band, the rectangular shaped principal element can be surrounded by the tinted band, making the antenna less noticeable to vehicle occupants.

In yet another aspect of the invention, means for tuning the antenna can be provided by an optional auxiliary element. The auxiliary element is preferably formed from the same transparent conducting film as the principal element, and has the general shape of a vertically elongated rectangle. The auxiliary element has its upper end electrically connected to the center of the lower edge of the principal element, and extends in a downwardly direction to give the antenna a T-shaped configuration. The length of the auxiliary element influences the antenna impedance and can be specified to provide a degree of tuning.

These and other aspects and advantages of the invention may be best understood by reference to the following detailed description of the preferred embodiments when considered in conjunction with the accompanying drawings.

DESCRIPTION OF THE PREFERRED EMBODIMENTS

In the past, vehicle antennas have been formed by attaching thin transparent films of conducting materials to major central regions of window glass panels. The gain of such antennas generally increases as the surface resistivity of the film is decreased to approach that of a good conducting metal. For a given conductive film, its surface resistivity is usually reduced by increasing the thickness of the film, which diminishes its transparency. Consequently, as the resistivity of the presently known configurations of film antennas is decreased to reduce ohmic loss and improve antenna gain, these antennas will become less transparent. Eventually, the films will no longer be sufficiently transparent to vehicle occupants, making the antennas unacceptable due to their centralized location on vehicle windows.

As a general rule, the central region of a vehicle window is not considered sufficiently transparent when its transmittance is less than 70% for visible light. Commercially available conducting films typically require a direct current surface resistivity in the order or 4 to 8 ohms per square to achieve 70% transmittance. The gain of antennas fabricated from such films can be diminished by as much as 3 dB, due to the ohmic loss in the films.

The present invention recognizes and takes advantage of electromagnetic coupling existing between an antenna and the metallic structure of a vehicle. By effectively utilizing this coupling, it has been found that a thin film antenna can be restricted to the upper region of a vehicle window, and still provide acceptable antenna performance. Because the newly configured antenna does not occupy a major central portion of the window, less transparent films may be used to reduce ohmic loss and improve antenna gain.

Figure 1:
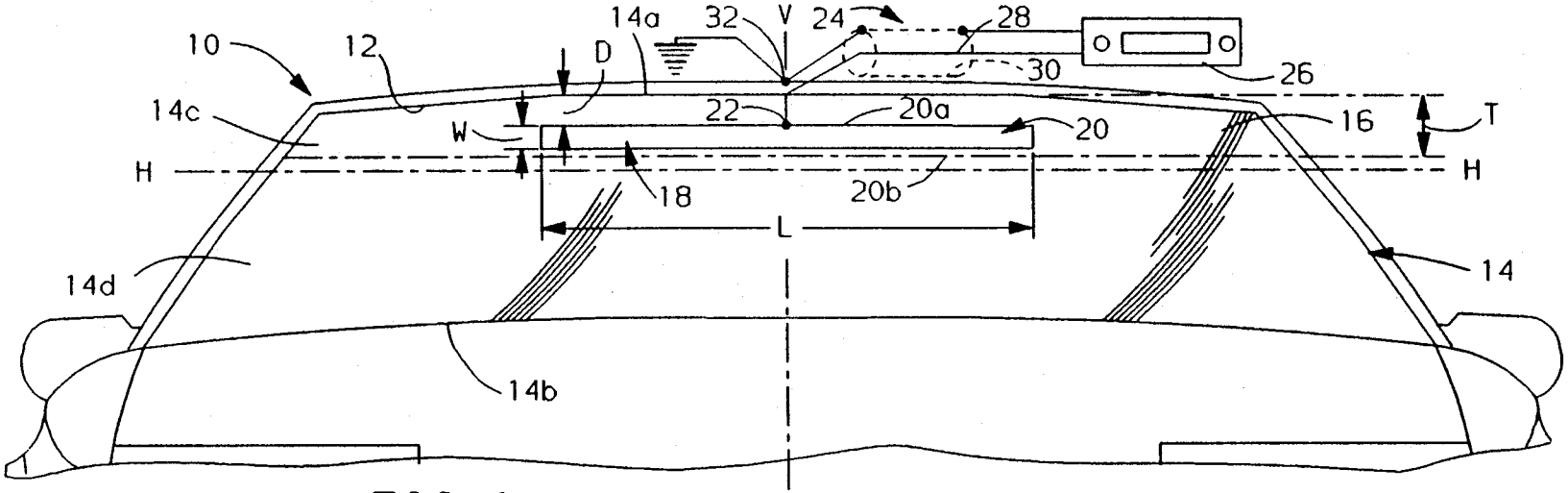
FIG. 1 represents a plan view of a vehicle window antenna formed of a thin transparent conducting film in accordance with the principles of the present invention.

Referring to FIG. 1, there is shown a portion of the metallic structure 10 of a vehicle, which forms an aperture 12 having window glass 14 disposed therein. Window glass 14 has a substantially horizontal top edge 14*a* and bottom edge 14*b* interfacing with the metallic structure 10 of the vehicle. A vertical axis V–V forms a center line along aperture 12 to symmetrically divide window glass 14 into equal right and left regions. A horizontal axis H–H along aperture 12, perpendicularly intersects the V–V axis to partition window glass 14 into an upper region 14*c* and a lower region 14*d*. For the purpose of describing the present invention, the upper region 14*c* of window 14 is defined to have a the distance separating top edge 14*a* and bottom edge 14*b* of window 14.

Preferably, window 14 is a standard laminated automobile windshield formed of two layers of glass with an interposing thermoplastic or polyvinyl butyral layer. Window 14 may optionally be provided with a longitudinally extending tinted band 16 across the top thereof, having a depth T in the transverse direction along the V–V axis. As will later be described, this tinted band may be utilized advantageously to further conceal film antennas fabricated in accordance with the principles of the present invention.

A window antenna representing one embodiment of the present invention, generally designated as 18, is shown supported by and disposed in the upper region 14*c* of window 14, above the H–H axis. The antenna includes a principal element 20 formed of a thin transparent film of electrically conducting material in a horizontally elongate, essentially rectangular shape. The principal element 20 is particularized by its horizontal length L, and transverse width W between its upper edge 20*a* and lower edge 20*b*, with the upper edge 20*a* being spaced a distance D from the top edge 14*a* of window glass 14.

In general, the transparent conductive film used in forming principal element 20 may be a single-layer film, for example, a single layer of indium-tin-oxide or a conducting metal such as copper or silver; or alternatively, it may be a multi-layer film having heat-reflecting ability, such as provided by layers of silver and titanium dioxide. In fact, any thin film of material having suitable transparency and conductivity, as described hereinafter, may be employed in forming antenna 18.

Techniques for attaching the thin conducting film onto or inside window glass 14 are well known in the art. For example, a film of a conducting material such as copper or silver can be deposited directly on the surface of window glass 14 by sputtering or other physical or chemical vapor deposition techniques. Alternatively, the conducting film can be deposited onto a polyester sheet, which is then sandwiched between glass laminates during the window fabrication process. Preferably, the film is formed in a continuous pattern, however, it may be advantageous to deposit the conducting material in a mesh-like pattern, thereby increasing the transparency of the film through the mesh openings.

A coax cable 24, as shown schematically in FIG. 1, is used to electrically connect a radio wave receiver/-transmitter 26 to the principal element 20 of the antenna 18 and the metallic structure 10 of the vehicle. Inner conductor 28 of cable 24 is fastened to a feed point 22 at the upper edge 20*a* of principal element 20, while the outer conductor or shield 30 is attached to a ground point 32 on the metallic vehicle structure 10. Ground point 32 is generally located directly adjacent to feed point 22, and as close as practicable to the top edge 14*a* of window glass 14. Optionally, a thin filament of the same transparent conducting film used to form principal element 20 could be extended upward from feed point 22, to the top edge 14*a* of window glass 14. Inner conductor 28 could then be electrically attached to the filament at the edge of the window rather than at feed point 22.

The electrical connection between conductor 28 and the thin conducting film of principal element 20 can be established by using commercially available conductive adhesives or mechanical fasteners. Many other standard approaches for effectuating a good electrical connection between a thin film and a conductor are generally known and will not be further discussed in the specification.

In electrically feeding the principal element 20 with respect to ground point 32, as described above, the principal element 20 is electromagnetically coupled to the vehicle metallic structure 10, primarily across the top edge 14*a* of window glass 14. The inventors have recognized that by adjusting this coupling, the performance of antenna 18 may be enhanced to approach that of a vehicle mounted whip or mast type antenna.

As is generally the case for an antenna mounted on or near a conducting structure having a complex shape, the coupling between the principal element 20 and the surrounding metallic vehicle structure 10 is not readily analyzable in a mathematical sense. However, it is known that the nature and degree of this electrical coupling, and its effect on antenna performance, will depend upon the position of feed point 22 on the upper edge 20*a* of principal element 20; the physical size and location of principal element 20 on the window glass 14; the shape of aperture 12 and the metallic structure 10 of the vehicle; the dielectric properties of the window glass 14; and the frequency range (band) of the radio waves to be received/transmitted by antenna 18.

For a particular vehicle having a specific aperture 12 and window glass 14 therein, the optimal feed point location, length L, width W, and position of principal element 20 on the window glass 14 may be determined empirically by measuring antenna gain and the impedance developed between feed point 22 and ground point 32, while varying these parameters of antenna 18. It has been found that this can be conveniently accomplished by initially forming principal element 20 from a commercially available, highly conductive, aluminum tape. The tape can be easily moved on the window and/or reduced in size to obtain the approximate dimensions and spacing for antenna 18, prior to forming it from the actual conducting film material. It has been found that the primary effect resulting from the substitution of a relative low loss film for the aluminum tape is a slight decrease in average antenna gain, due to the ohmic loss in the film.

The length L of the principal element is selected to achieve a zero reactive impedance component for the antenna 18 at a resonant frequency $f_o$, which is customarily near the mean frequency for a band of radio waves to be received/transmitted by antenna 18. For each film antenna that has been fabricated, the measured resonant length L has been less than $\lambda_o/4$, where $\lambda_o$ is the free space wavelength associated with the chosen resonant frequency $f_o$. This is an unexpected result, since one would normally expect the resonant length of a structure such as principal element 20, to approximately be integer multiples of one-half $\lambda_o$; but here, the resonant length is substantially reduced, due to the coupling with the vehicle. Allowing for vehicle to vehicle variations, it is believed that for most applications, the resonant length for the principal element 20 will reside in the range, $3\lambda_o/8 \geqq L \geqq \lambda_o/8$.

After determining the resonant length of the antenna, the width W and spacing D of principal element 20 are selected to maximize antenna gain for the particular application, while restricting the lower edge **20*b* of principal element 20 to the upper region 14*c* of window 14. This last requirement is satisfied if the sum of dimensions W and D does not exceed one-third of the transverse width of window glass 14** along its center line (axis V-V).

For a sample vehicle, a film antenna was fabricated for the FM broadcast band (88-108 MHz), in accordance with the principles of the present invention. The principal element 20 was formed from a thin film of copper having a direct current surface resistivity of approximately 2 ohms per square. A standard 50 ohm RG 58 coax was used as the cable 24 to feed antenna 18. For this application, it was found that a principal element 20 of length L=0.610 m (0.2 $\lambda_o$, for $f_o$=100 MHz) was resonant at 96 MHz, which for all practical purposes is the center of the FM band. The gain of antenna 18 was found to be largest when principal element 20 was symmetrically located about the vertical center line of window 14 (the V—V axis), with feed point 22 positioned at the center of its upper edge **20*a*; and principal element 20 was given a width of W=0.051 m, and a spacing D=0.114 m from the upper edge 14*c* of the window. For this configuration, the lower edge 20*b* of principal element 20 extends a distance of W+D=0.165 m below the upper edge 14*c* of window 14**. This is within the upper region of standard vehicle windows, which typically have transverse widths of at least one-half meter.

Thus, a transmittance of less than 70% for principal element 20 should be acceptable to vehicle occupants, since principal element 20 has been restricted to the upper region of window 14, out of the central viewing area. As a consequence, thin films having relatively low surface resistivities can be used in forming antenna 18, thereby reducing ohmic loss and increasing antenna gain.

The vertical and horizontal polarized FM gains of the above described film antenna and a conventional rear mounted whip on the sample vehicle were measured at three frequencies, 88.2, 98.4, and 108.2 MHz. On the average, the gain of film antenna 18 was found to be 2.4 dB below that of the rear mounted whip, indicating that it is an acceptable replacement for the whip in the FM band. Generally, if the average gain of an antenna is more that 6 dB below that of a whip, it should not be considered as an acceptable replacement. Additionally, film antenna 18 was found to have an average voltage standing wave ratio (VSWR) of 1.7 in the FM band, with respect to a 50 ohm reference, indicating a good antenna impedance match with the 50 ohm RG 58 coax cable 24.

The average gain of film antenna 18 was also measured for the AM broadcast band (560-1600 KHz), and found to be approximately 10.9 dB below that of the rear mounted whip antenna. However, it was found that the AM gain could be increased by 8.2 dB, to an acceptable level, if 125 ohm RG 62 A/U modified coax was used in place of the RG 58 coax cable 30 to feed antenna 18. The RG 62 A/U cable has roughly one-third the distributed capacitance of the RG 58 cable, so less AM signal is shunted to ground, thereby effectively increasing the AM gain for receiver/transmitter 26. This substitution of cable does, however, result in approximately 2.2 dB decrease in the average FM gain of antenna 18, since it was more nearly impedance matched to the 50 ohm RG 58 cable.

Figure 2:
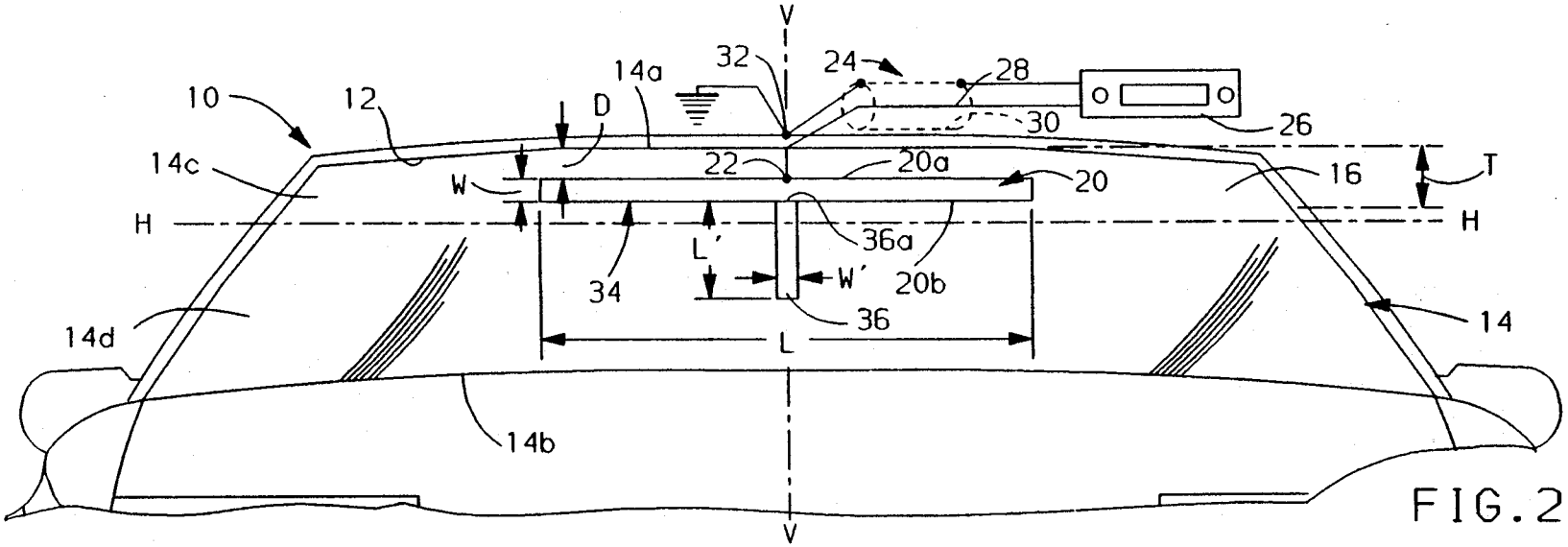
FIG. 2 represents a plan view of a thin film antenna for a vehicle window, which further includes an auxiliary impedance tuning element.

Referring now to FIG. 2, there is shown a second embodiment for a transparent film antenna, generally designated as 34, which includes means for tuning the antenna impedance. Note that the same numerals are used in FIGS. 1 and 2 to denote identical structure. Film antenna 36 comprises the principal element 20, as previously described, and further includes an auxiliary element 36, which can be used to tune the antenna impedance developed between feed point 22 and ground point 32. In the preferred embodiment, auxiliary element is formed of thin transparent conducting film in the general shape of a vertically elongated rectangle having a length L' and width W'. An end **36*a* of auxiliary element 36 is electrically connected to principal element 20 near the center of its lower edge 20*b*, giving antenna 34** a T-shaped configuration.

In effect, the auxiliary element 36 behaves as a short inverted vertical monopole, with respect to the metallic structure 10, with an associated impedance which varies primarily as a function of its length L'. By attaching auxiliary element 36 to principal element 20, their respective impedances essentially combine in parallel and appear as the total impedance for antenna 34 between feed point 22 and ground point 32. As a result, the impedance of antenna 34 can be tuned by adjusting the length L' of auxiliary element 36. This can be particularly useful in improving the impedance match between a particular coax cable 24 and film antenna 34 to maximize antenna gain. Of course, the presence of the auxiliary tuning element 36, down the center line of the window, must be acceptable in the particular application.

The same conducting film may be used to form both principal element 20 and auxiliary element 36, in which case, tope edge **36*a* of auxiliary element 36 would not physically exist, since both of these portions of antenna 34 would normally be fabricated at the same time. Alternatively, different conducting films could be used when forming the principal element 20, and auxiliary element 36. This might be desirable, for example, to increase the transparency of the auxiliary element, which can pass through the center region of window 14 along the center line. As another alternative, auxiliary element 36** could also take the form of a thin wire, fashioned from an electrically conducting metal such as copper, which would be even less noticeable to vehicle occupants.

A film antenna 34 was fabricated and attached to the window 14 of a second sample vehicle. The principal element 20 and auxiliary element 36 were both formed from a copper film having a surface resistivity of 2 ohms per square. For this configuration and particular vehicle, the optimal values for the dimensional parameters of the principal element 20 were found to be L=0.508 m, W=0.051 m, and D=0.076 m. The auxiliary element was given a width W'=0.051 m, which was equivalent to that of the principal element 20.

The impedance of antenna 34 was measured for different lengths L' of the auxiliary element, and the best impedance match to a 125 ohm RG 62 A/U coax cable 24 was obtained when L'=0.508 m. For this length of L', the VSWR of the cable 24 and film antenna 34 combination was reduced from 5.3, to an acceptable value of 2.5. The average FM gain of film antenna 34 was found to be 0.6 dB below that of a rear mounted whip antenna, while the average AM gain was 1.3 dB above that of the whip antenna. Thus, for this application, antenna 34 represents an acceptable replacement for a rear mounted whip antenna.

It will now be readily apparent that the present invention provides a transparent film antenna for the window of a vehicle, which affords satisfactory performance and is not unsuitably conspicuous to vehicle occupants. Although the preferred embodiments of the present invention have been described in terms of antennas for AM/FM reception, it will be understood by those skilled in the art that the principles underlying the present invention can be used to provide antennas useful at other frequencies such as in the commercial TV or mobile telephone bands. Thus, the aforementioned description of the preferred embodiments of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. An antenna for receiving and transmitting electromagnetic radio waves from a motor vehicle, the vehicle having a metallic structure forming an aperture with a window glass disposed therein, the window glass having an upper region and substantially horizontal top and bottom edges interfacing with the metallic structure, the antenna comprising:

a principal element formed of a thin transparent film of electrically conducting material supported by the vehicle window glass, the principal element being horizontally elongate and having a generally rectangular shape with upper and lower edges separated by a width W, the upper edge of the principal element being spaced at a distance D from the top edge of the window such that the sum of W and D does not exceed one-third of the distance separating the top and bottom edges of the window, thereby confining the principal element to the upper region of the window glass;

means for electrically feeding the principal element with respect to a ground point on the vehicle to effectively couple the principal element electromagnetically to the vehicle metallic structure; and means for tuning an antenna impedance developed between the principal element and the ground point on the vehicle, the tuning means comprising an auxiliary element formed of the thin transparent film and shaped as a vertically elongated rectangle, the auxiliary element having an upper end electrically connected to the center of the lower edge of the principal element and extending downwardly therefrom to provide a T-shaped antenna configuration, the auxiliary element having a specified length, which influences the impedance of the antenna.

2. An antenna for receiving and transmitting electromagnetic radio waves from a motor vehicle, the vehicle having a metallic structure forming an aperture with a window glass disposed therein, the window glass having an upper region and substantially horizontal top and bottom edges interfacing with the metallic structure, the antenna comprising:

a principal element formed of a thin transparent film of electrically conducting material supported by the vehicle window glass, the principal element being horizontally elongate and having a generally rectangular shape with upper and lower edges separated by a width W, the upper edge of the principal element being spaced at a distance D from the top edge of the window such that the sum of W and D does not exceed one-third of the distance separating the top and bottom edges of the window, thereby confining the principal element to the upper region of the window glass;

an antenna feed point disposed at the upper edge of the principal element for electrically feeding the antenna; and an auxiliary element formed of the thin transparent film and shaped as a vertically elongated rectangle, the auxiliary element having an upper end electrically connected to the center of the lower edge of the principal element and extending downwardly therefrom to provide a T-shaped antenna configuration, the auxiliary element having a specified length, which influences the impedance of the antenna.

* * * * *

UNITED STATES PATENT AND TRADEMARK OFFICE

CERTIFICATE OF CORRECTION

PATENT NO. : 5,083,135

DATED : January 21, 1992

INVENTOR(S) : Louis L. Nagy and Frank T. C. Shum

It is certified that error appears in the above-identified patent and that said Letters Patent is hereby corrected as shown below:

Title Page, [75] Inventors: delete ";Jimmy L. Funke, Mt. Clemens, Mich."

Signed and Sealed this

Third Day of August, 1993

*Attest:*

Michael K. Kirk

MICHAEL K. KIRK

*Attesting Officer*

*Acting Commissioner of Patents and Trademarks*